US006932530B1

(12) United States Patent
Bissel

(10) Patent No.: US 6,932,530 B1
(45) Date of Patent: Aug. 23, 2005

(54) SPREADABLE FOOD PRODUCT DISPENSER

(76) Inventor: Steve Bissel, 47 Ashton St., Beverly, MA (US) 01915

( * ) Notice: Subject to any disclaimer, the term of this patent is extended or adjusted under 35 U.S.C. 154(b) by 0 days.

(21) Appl. No.: 10/631,177

(22) Filed: Jul. 31, 2003

(51) Int. Cl.[7] ..... A46B 11/00; B05C 11/00; B43K 5/06

(52) U.S. Cl. ..... 401/11; 401/12; 401/266; 401/175

(58) Field of Search ..... 401/261–267, 401/9, 11, 12, 68, 172–175

(56) References Cited

U.S. PATENT DOCUMENTS

| | | | | | |
|---|---|---|---|---|---|
| 2,458,120 | A | * | 1/1949 | Volpini | 401/12 |
| 2,811,844 | A | * | 11/1957 | Selmer | 118/13 |
| 2,980,247 | A | * | 4/1961 | Di Giantomasso | 401/79 |
| D217,007 | S | * | 3/1970 | Smith | D7/670 |
| 4,544,083 | A | * | 10/1985 | Schroeder | 222/47 |
| 4,545,696 | A | | 10/1985 | Carluccio | |
| 4,605,330 | A | | 8/1986 | Crowley et al. | |
| 4,981,041 | A | * | 1/1991 | Merkle | 73/426 |
| 5,275,496 | A | | 1/1994 | Fattori et al. | |
| 5,538,161 | A | | 7/1996 | Koehler et al. | |
| 5,553,957 | A | | 9/1996 | Dornbusch et al. | |
| D381,899 | S | | 8/1997 | Crawford | |
| 5,797,692 | A | * | 8/1998 | Poole et al. | 401/266 |
| 6,096,296 | A | | 8/2000 | Alflen et al. | |

* cited by examiner

*Primary Examiner*—David J. Walczak
(74) *Attorney, Agent, or Firm*—Hamilton, Brook, Smith & Reynolds, P.C.

(57) ABSTRACT

A container for dispensing a spreadable food product consists of a housing, a platform positioned within the housing for supporting the spreadable food product, a dispensing mechanism mounted in the housing and attached to the platform for moving the platform from the bottom end of the housing towards the open top end of the housing along an axis for dispensing the spreadable food product, and a cover for covering the housing when not in use. The top end may be of convex, concave, slotted or other shapes and designs.

10 Claims, 4 Drawing Sheets

SPREADABLE FOOD PRODUCT DISPENSER

BACKGROUND OF THE INVENTION

The present invention relates to a dispenser for a spreadable food product, such as solid butter, butter substitute spreads (e.g., margarine), cream cheese, jellies, nut butters, fruit butters or other similar materials.

Solid butter, cream cheese, or other food products that are sensitive to temperature and melt at hotter temperatures are usually available either in plastic or cardboard tubs of various sizes or wrapped in a wrapper while shaped in a parallelepiped shape. To use the product, people scoop out the substance with knives or other implements and spread it on food items, such as bread, corn, etc. Spreading it on such things as corn on the cob, in particular, may prove challenging at times: 1) it is often difficult to get the pieces of butter evenly dispensed over the surface of the corn cob, 2) further depending on the temperature of the butter being spread, the butter may be crumbly and unmanageable.

In general, there are various serving methods and implements for serving and spreading such spreadable food products. Although some containers in which spreadable food products are made available may be suitable as serving containers, these containers do not allow for easy spreading, and additional implements are required to get the food product out of the container and onto the desired cooperating food.

SUMMARY OF THE INVENTION

The present invention provides a solution to serving and spreading spreadable food products, especially butter on corn on the cob. A container for dispensing a spreadable food product consists of a housing, a platform positioned within the housing for supporting the spreadable food product, a dispensing mechanism mounted in the housing and attached to the platform for moving the platform from the bottom end of the housing towards the open top end of the housing along an axis for dispensing the spreadable food product, and a cover for removably covering the housing when not in use.

The open top end of the housing may be shaped in a concave shape to receive a cylindrical food object. In another embodiment of the invention, the open top end of the housing may be shaped in a convex shape. In another embodiment, the open top end is of a grid or slotted design.

The container may contain the spreadable food product or it may be designed such that users can fill it up themselves. The spreadable food product may be butter, margarine, cream cheese, nut butters, fruit butters, jellies or others.

The platform on which the spreadable food product is located may be shaped to resemble the shape of the open top end of the housing, or in any other shape as determined by one skilled in the art.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
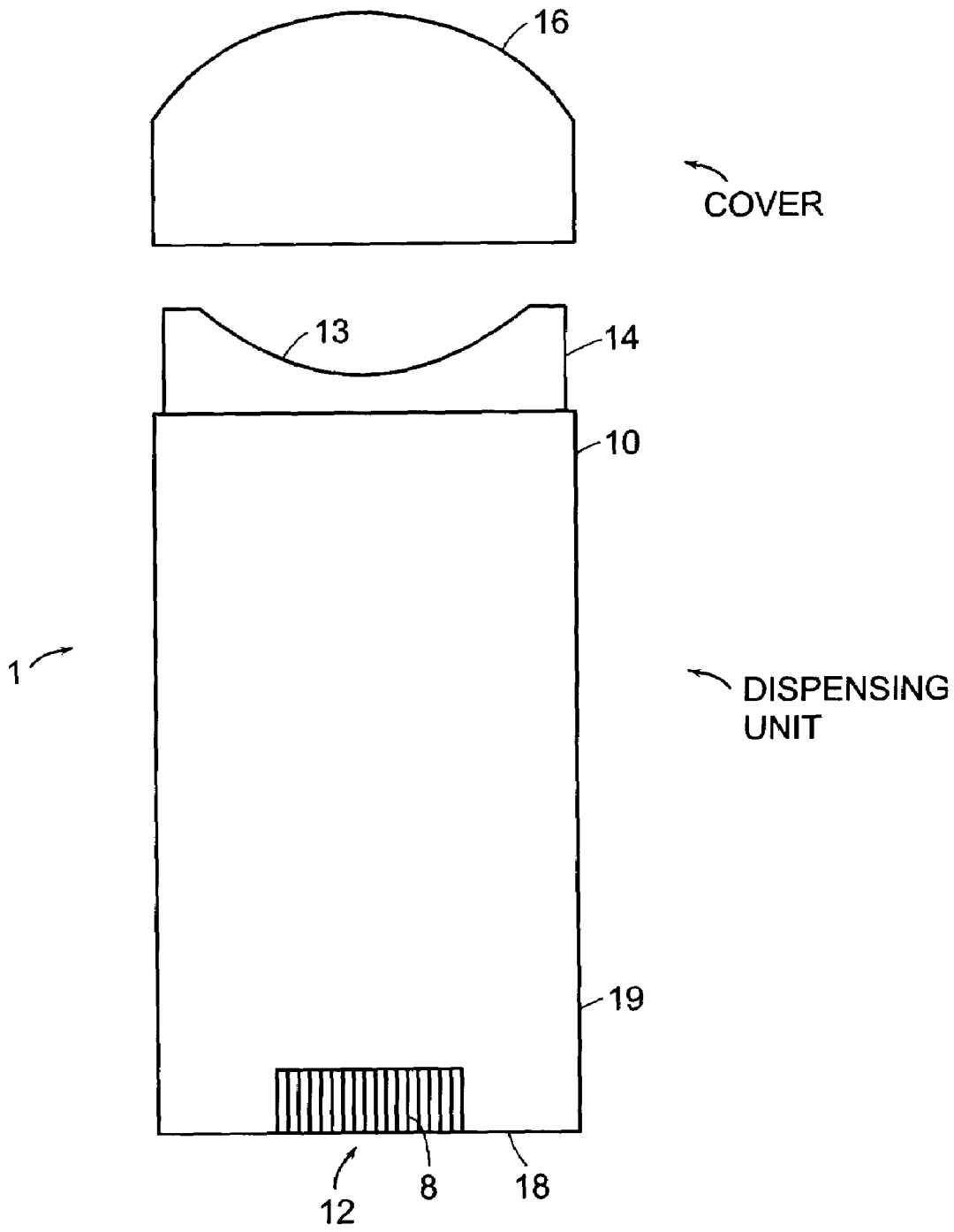
FIG. 1 is a perspective view of a spreadable food product dispenser-container according to one embodiment of the present invention.

As illustrated in FIG. 1, the present invention is a dispenser-container 1 for storing and dispensing spreadable food products, such as butter, margarine, cream cheese, preserves (jams, jellies), nut butters (peanut butter, almond butter, etc.), fruit butters or any other product with similar consistencies or temperature-related properties. The dispenser-container 1 includes a housing or dispensing unit 10, a platform 22 (FIG. 2), and a dispensing member 12. The general construction and composition of the housing 10, the platform 22, and the dispensing member 12 are well known in the art and may take a variety of shapes and forms.

The housing 10 is typically constructed of injection molded plastic and includes an open top end 14 for dispensing the butter and/or spreadable food product contained therein, a bottom end 18 for supporting the dispensing member 12, and a side wall 19 for retaining the butter and/or spreadable food product.

In a preferred embodiment, the top end 14 has walls with concave upper edges 13 as shown in FIG. 1, for ease of dispensing the spreadable food product on contoured surfaces and objects such as corn cobs. The concave shaped upper edges 13 can receive a cylindrical food object and effectively maintain the spreadable food product in contact with the cylindrical food object, thereby dispensing the spreadable food product evenly on the cylindrical food object. For example, a corn cob can slide back and forth through the concave shaped upper edges 13 of the dispensing unit or be rotated about its longitudinal axis while poised under the concave shaped upper edges 13. In either case, this allows for even dispensing of the spreadable food product from the container 1 onto the corn cob.

Figure 4A:
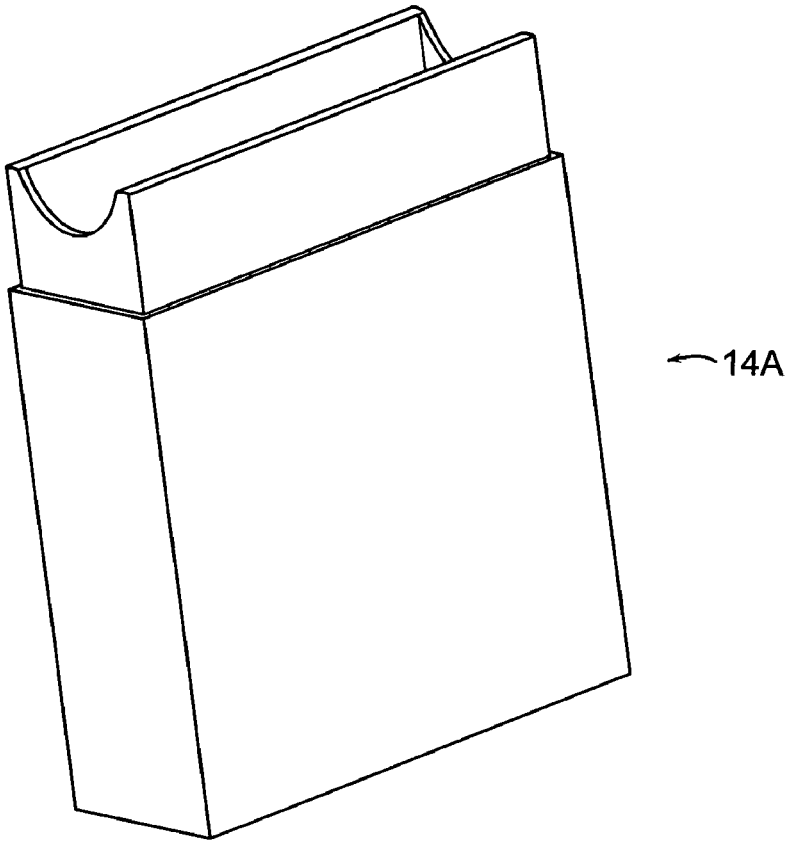
FIGS. 4*a*–4*d* illustrate top ends of alternative embodiments.
Figure 4B:
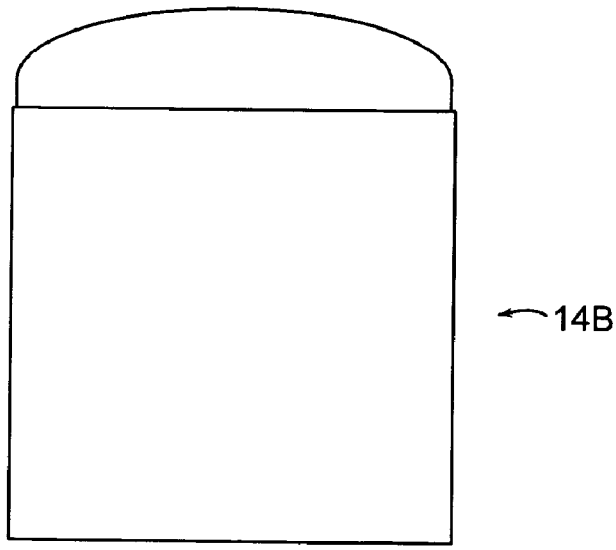

The present invention is not limited to a particular shape of the top end 14. In an alternative embodiment of the invention, the concave upper edges 13 may be perpendicular to what is shown in FIG. 1. This is illustrated as top end 14*a* in FIG. 4*a*. In yet another embodiment of the invention, the upper edges of top end 14*b* may be convex as shown in FIG. 4*b*, or even substantially straight, as determined by one skilled in the art.

Figure 4C:
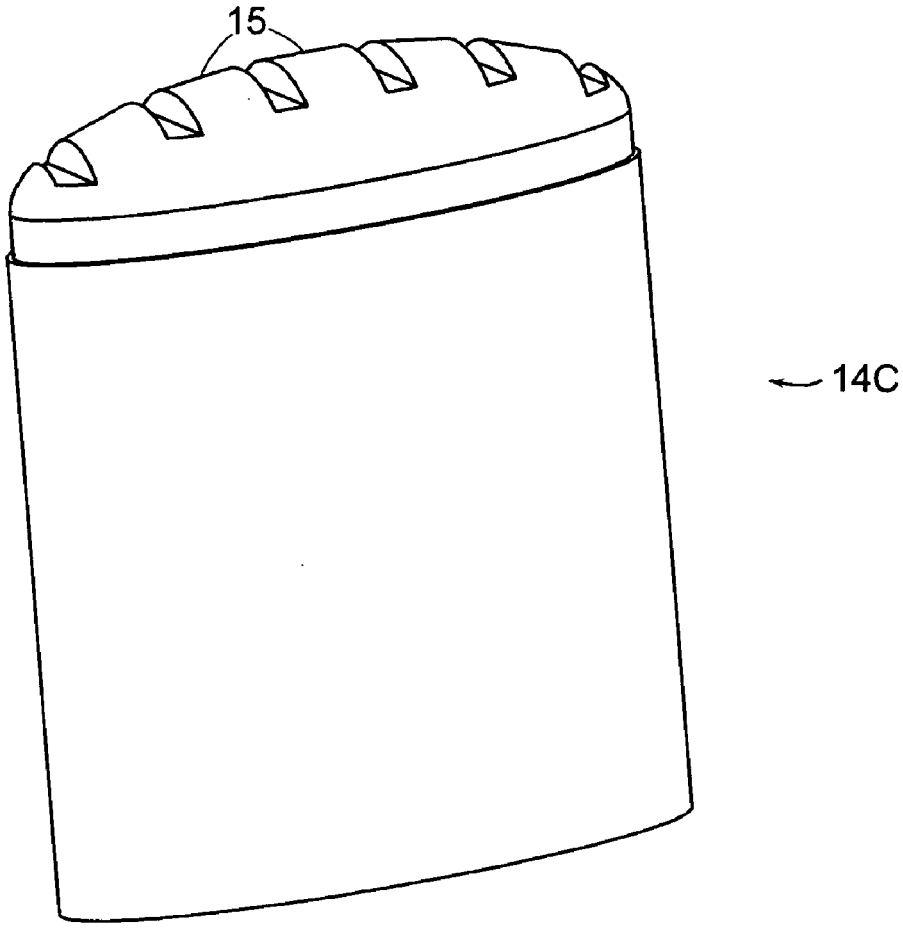
Figure 4D:
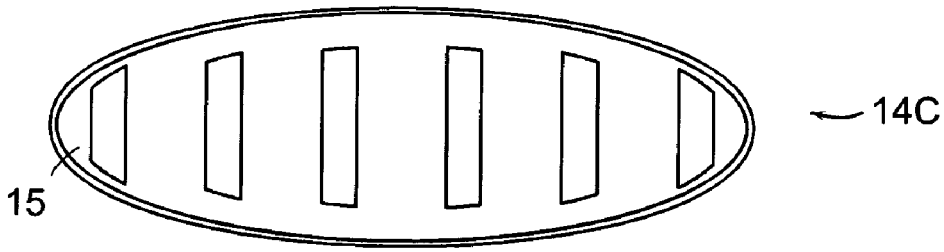

FIGS. 4*c* and 4*d* show side and top views respectively of top end 14*c* of an alternative design (namely slotted). In this design, ribs 15 provide a grid and slots at upper edge 13 through which the food product is dispensed from container 1. Slotted top end 14*c* is designed for dispensing and spreading jellies, jam, peanut/nut butters and the like. Number and width of ribs 15 may be different in different embodiments and are within the purview of one ordinarily skilled in the art.

Other designs are suitable for top end 14.

Returning to FIG. 1, there is a cover 16 for covering the dispenser housing 10 when it is not in use. The particular shape of the cover may be varied as determined by one skilled in the art, for example, according to the type of product being dispensed by the dispenser. The cover 16 is generally removably attached to dispensing unit 10. In an alternative embodiment of the invention, the cover 16 may be permanently or semi-permanently attached to the dispensing unit 10 at one end, so that it may open with a flip-open action. In yet another embodiment of the invention, the cover may be threaded to screw on top of the housing 10 at the top end 14.

Figure 2:
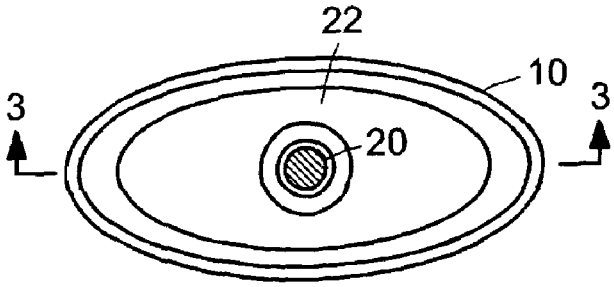
FIG. 2 is a top view of the embodiment of the dispenser-container of FIG. 1.
Figure 3:
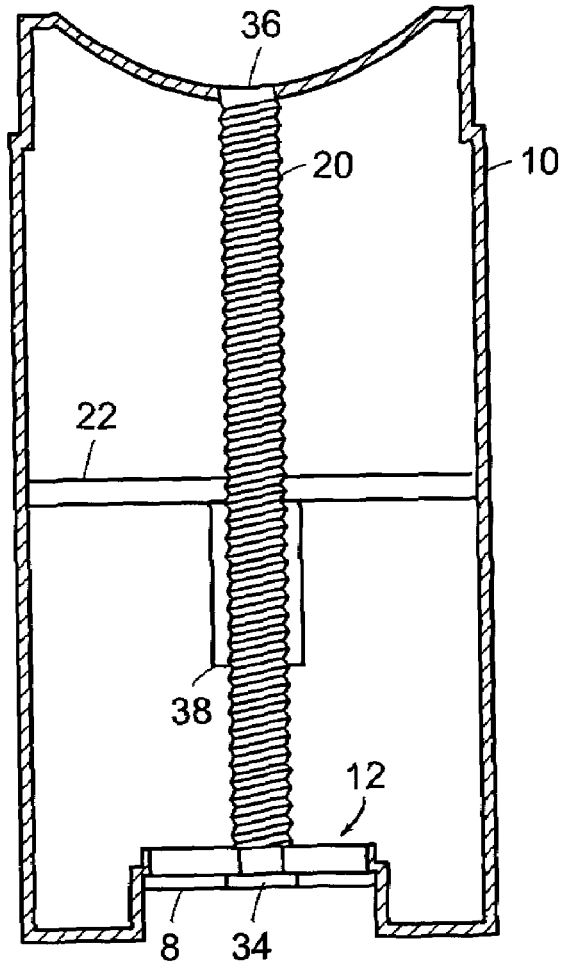
FIG. 3 is a cross-sectional view of the dispenser-container of FIG. 1 taken along the line 3—3 of FIG. 2.

With reference to FIGS. 2 and 3, the platform 22 is positioned within the housing 10 for supporting and propelling the spreadable food product (e.g., butter and/or cream cheese) contained within the housing 10. In an alternative embodiment of the invention, the platform may also include a side wall (not shown) for additional support. The platform 22 includes an additional protrusion 38, threaded for better interaction with the dispensing member 12. In an alternative embodiment of the invention, the platform may be shaped to resemble the shape of a convex or concave opening of the top 14 of the housing 10. In yet another embodiment, the platform may have additional protrusions at its upper surface in order to hold the spreadable food product (housing contents) in place.

The dispensing member 12 includes a rotary dial 8 (FIG. 1) and a threaded rod or screw 20 (FIG. 3). The threaded screw 20 has a first end 34 fixedly mounted to the rotary dial 8 and a second end 36, upon which the platform 22 is movably engaged. The platform 22 moves upward along the threaded screw 20 by rotation of the rotary dial 8. In turn, the contents of housing 10 (i.e., the spreadable food product) are pushed/moved along with the platform 22 longitudinally within housing 10. More particularly, turning the rotary dial 8 turns the threaded screw 20, thereby engaging a corresponding threaded portion 38 of the platform 22 for moving the platform 22, and hence the spreadable food product contained in housing 10, from the bottom end 18 of the housing 10 toward the open top end 14 of the housing 10 for dispensing the contents (e.g., butter and/or spreadable food product).

In one embodiment of the invention, the spreadable food product is loaded into the container 1 (dispensing unit 10) at the manufacturing site and through retail stores is distributed already enclosed in the dispenser-container 1. Such a dispenser-container unit 1 may be disposable, so that users may dispose of it once the platform 22 reaches the top end 14 of the dispensing unit 10 and no spreadable food product remains therein.

In an alternative embodiment of the invention, the dispenser-container 1 may be multi-use, such that users have an opportunity to load the dispensing unit/housing 10 with the spreadable food product of their choice. This loading may occur while the spreadable food product is in the slightly melted or solid state. In addition, food products may be sold in a shape convenient for loading into dispenser-container 1. In yet another embodiment of the invention, the dispensing unit/housing 10 may come originally pre-loaded with the spreadable food product, which the user refills as desired.

Numerous spreadable food products may be used with dispenser-container 1, their main characteristic being sensitivity to temperature, such that they melt at warmer temperatures and remain solid at colder ones. The spreadability of the food product increases with the temperature, so that whether the dispenser-container is stored in the refrigerator or outside may be determined by the users based on the type of food product being dispensed. In an alternative embodiment of the invention, dispenser-container 1 may be equipped with an additional cooling unit or, alternatively, a removable unit that may be stored in the refrigerator for a period of time, and then placed on or in the dispensing unit/housing 10 in order to maintain the colder temperature.

While this invention has been particularly shown and described with references to preferred embodiments thereof, it will be understood by those skilled in the art that various changes in form and details may be made therein without departing from the scope of the invention encompassed by the appended claims.

What is claimed is:

1. A container for dispensing a spreadable food product, said container comprising:

a housing having a top end with ribs which provide a grid and slots for dispensing the spreadable food product through said slots, a bottom end, and a side wall;

a platform positioned within the housing for supporting the spreadable food product, the spreadable food product being supported on a top surface of the platform;

a dispensing member mounted in the housing and attached to the platform for moving the platform from the bottom end of the housing towards the open top end of the housing along an axis for dispensing the spreadable food product, wherein the dispensing member includes:

(a) a threaded rod upon which the platform is movably engaged; and (b) a rotary dial for turning the threaded rod, and thereby moving the platform; and a cover for covering the top end of the housing when not dispensing the spreadable food product, wherein the spreadable food product is pre-loaded within the housing such that the container is a one-time use dispenser.

2. The container of claim 1, wherein the open top end of the housing is shaped in a convex shape.

3. The container of claim 1, wherein the spreadable food product is at least one of: butter, margarine, jelly, jam, nut butter and cream cheese.

4. The container of claim 1, wherein the platform is shaped to resemble the shape of the top end of the housing.

5. A method for dispensing a spreadable food product comprising the steps of:

(a) providing a container for dispensing a spreadable food product, the container being formed of:

a housing having an open top end for dispensing the spreadable food product, a bottom end, and a side wall;

a platform positioned within the housing for supporting the spreadable food product, the spreadable food product being supported on a top surface of the platform; and a dispensing member mounted in the housing and attached to the platform for moving the platform from the bottom end of the housing towards the open top end of the housing along an axis for dispensing the spreadable food product, wherein the dispensing member includes:

(1) a threaded rod movably engaging the platform; and (2) a rotary dial for turning the threaded rod, and thereby moving the platform;

(b) filling the container with an initial amount of the spreadable food product, resulting in a filled container;

(c) providing the filled container as a one-time use dispenser dispensing the spreadable food product for consumption; and (d) disposing of the container after the initial amount of spreadable food product is used.

6. A method as claimed in claim 5, wherein the open top end of the housing is shaped in a concave shape to receive a cylindrical food object.

7. A method as claimed in claim 5, wherein the open top end of the housing is shaped in a convex shape.

8. A method as claimed in claim 5, wherein the open top end of the housing is slotted.

9. A method as claimed in claim 5, wherein the spreadable food product is at least one of: butter, margarine, jelly, jam, nut butter and cream cheese.

10. A method as claimed in claim 5, wherein the platform is shaped to resemble the shape of the open top end of the housing.

* * * * *